United States Patent [19]

Matovich, Jr.

[11] 4,084,489

[45] Apr. 18, 1978

[54] METHOD OF FORMING CARTON

[76] Inventor: Mitchel J. Matovich, Jr., 19100 Bainter Ave., Los Gatos, Calif. 95030

[21] Appl. No.: 739,368

[22] Filed: Nov. 5, 1976

Related U.S. Application Data

[62] Division of Ser. No. 628,444, Nov. 3, 1975, Pat. No. 4,011,984.

[51] Int. Cl.[2] ..... B31B 49/02

[52] U.S. Cl. ..... 93/36.8; 53/377; 93/39.1 P; 93/49 M

[58] Field of Search ..... 93/36.8, 39.1 P, 55.1 R, 93/49 M, 49 R; 53/376, 377; 239/37 R, 43

[56] References Cited

U.S. PATENT DOCUMENTS

| | | | |
|---|---|---|---|
| 2,949,151 | 8/1960 | Goldstein | 229/37 R X |
| 3,041,942 | 7/1962 | Repking | 93/39.1 P X |
| 3,097,783 | 7/1963 | Burt et al. | 229/37 R |
| 3,341,104 | 9/1967 | Loheed et al. | 229/37 R |
| 3,933,297 | 1/1976 | Carlsson et al. | 229/43 X |

*Primary Examiner*—James F. Coan
*Attorney, Agent, or Firm*—Knobbe, Martens

[57] ABSTRACT

A one-piece blank which may be formed into a liquid-tight carton is T-shaped and is comprised of side wall panels integrally interconnected and numbering three or more to provide a carton of polygonal cross section. One of the side wall panels has integrally connected carton end closure panels to be folded down upon and sealed to sealing tabs of the other side panels after the blank has been formed by a side-seam operation into an open-ended tube. The end closure panels are of substantially the same area as the cross-sectional area of the carton but are not provided with sealing flaps. They are embossed marginally around their free edges to provide a curvature for contact with the sealing tabs when the ends of the carton are closed by rendering the closure panels and the sealing tabs mutually adhesive and pressing the closure panels down upon the sealing tabs.

5 Claims, 8 Drawing Figures

FIG. 1.
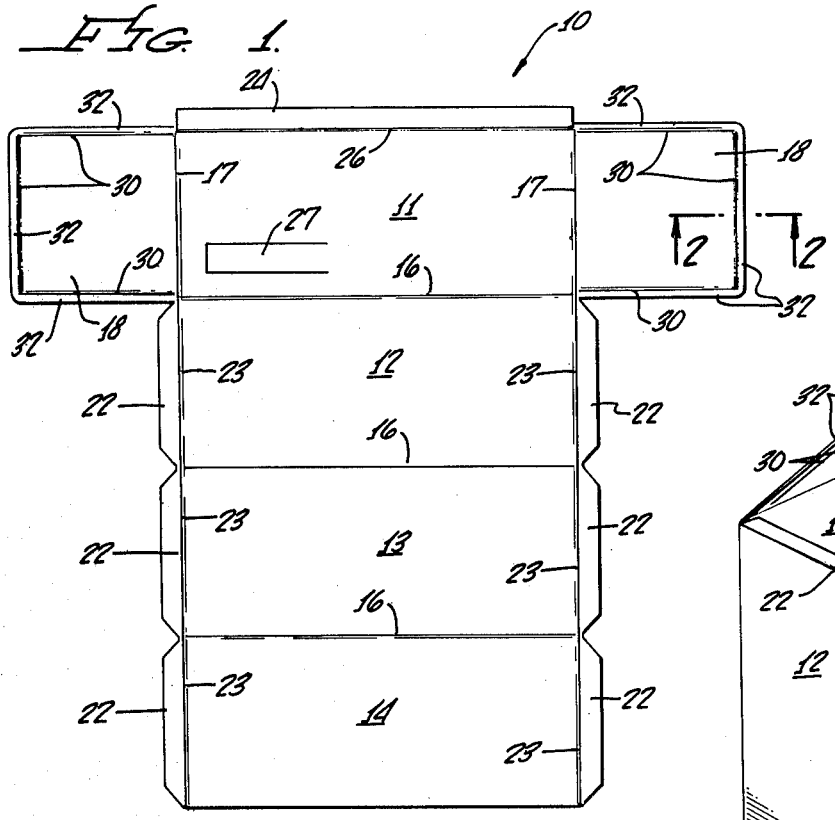
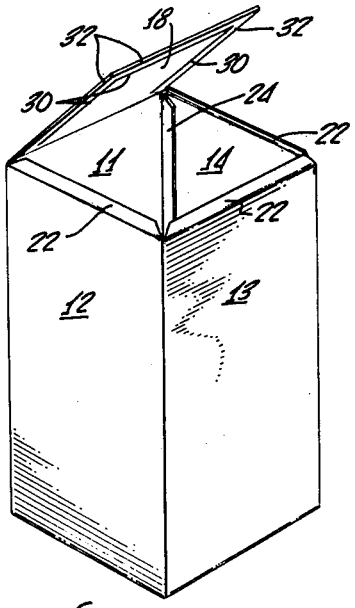
FIG. 3.
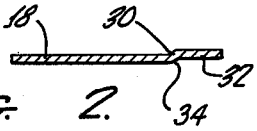
FIG. 2.
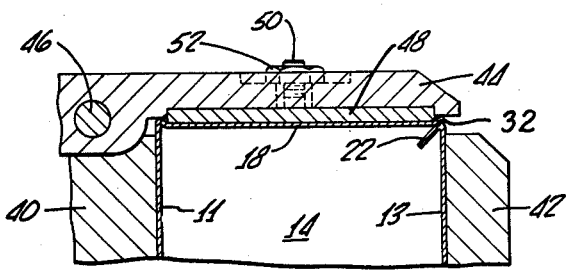
FIG. 4.
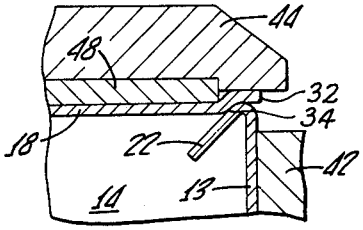
FIG. 5.

METHOD OF FORMING CARTON

This is a division of application Ser. No. 628,444, filed Nov. 3, 1975, which matured into U.S. Pat. No. 4,011,984 granted Mar. 15, 1977.

BACKGROUND OF THE INVENTION

U.S. Pat. No. 3,749,300, granted July 31, 1973 to Charles Wright Jones discloses a one-piece T-shaped blank for forming a carton to hold liquids, such as beverages. The T shape results from the provision of end closure panels at the ends of one of the side wall panels of the carton. Each of the other side wall panels is provided at its ends with sealing tabs to be bent inwardly after the blank has been folded into the configuration of an open-ended tube and side-seamed by means of a side-seam flap carried by the same side wall panel with which the two end closure panels are associated. The free edges of the end closure panels are also provided with sealing tabs and the closure of an end of the carton involves the pressing down of an end closure panel upon and sealing it to the sealing tabs of the other side wall panels and in addition the folding down and sealing of the sealing tabs on the end closure panel to the outside surfaces of the other side wall panels.

BRIEF DESCRIPTION OF THE INVENTION

The carbon blank which is the subject of the present invention is an improvement on the one disclosed in the hereinbefore identified patent and differs therefrom in two aspects, both involving the end closure panels. One of these differences is the elimination of the sealing tabs of the end closure panels which in the forming of the prior art carton were folded down against and sealed to the outer surfaces of the carton walls. The other difference is that along their free edges the two end closure panels are marginally embossed outwardly relative to the plane of the blank, which leaves the area of each closure panel depressed inside those margins. The transition from the marginal embossing to the area of the closure panel bounded by the marginal embossing is a curve, and when a closure panel is pressed down upon the sealing tabs and sealing is effected by rendering the confronting surfaces mutually adhesive the curvature produced by the embossing presses downwardly upon the sealing tabs, forcing the tabs to bend obliquely downwardly into the carton with the result that adherence of the closure panel to the sealing tabs occurs not only between the inner surface of the marginally embossed portions of the closure panel and the surface of sealing tab just inside its point of flexure inwardly of the carton, but takes place additionally between the curved transition resulting from the marginal embossing of the closure panel and the obliquely downwardly directed sealing tab. It has been found that this results in a superior liquid-tight seal in the closure of the carton as compared with sealing by causing adherence of a flat closure panel to the sealing tab. Moreover a saving in material results from the elimination of the sealing tabs on the closure panels, as will be more fully set forth hereinafter.

DESCRIPTION OF THE DRAWINGS

For a complete understanding of the invention reference may be had to the following detailed description to be interpreted in the light of the accompanying drawings wherein:

FIG. 1 is a plan view of a carton blank in accordance with a preferred embodiment of the invention;

FIG. 2 is a sectional view taken on the line 2—2 of FIG. 1;

FIG. 3 is a perspective view showing a carton formed from a blank of the type shown in FIG. 1, closed at the lower end and open at the upper end;

FIG. 4 is a vertical sectional view through a carton in the process of having its upper end closure panel sealed to the carton and including fragmentary sectional showings of apparatus for effecting the closure of the carton;

FIG. 5 is an enlarged sectional view of a portion of FIG. 4;

DETAILED DESCRIPTION

Figure 6:
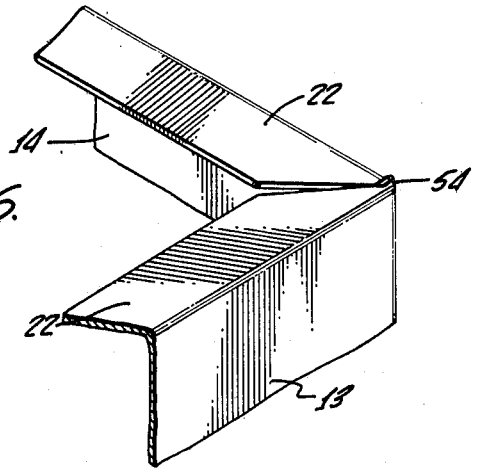
FIG. 6 is an enlarged fragmentary perspective view showing a corner of a carton with the sealing tabs generally in the positions they assume upon closing of the ends of the carton.

Referring now to the drawings and particularly to FIG. 1 the reference numeral 10 designates a blank of T-shaped configuration, from which a complete carton, sealed to be liquid tight, may be derived without requiring any other carton body components. The blank is comprised of four carton side wall panels 11, 12, 13 and 14 separated or delineated by indentation lines or scorings 16 along which folding of the blank into carton configuration may take place. The wall panel 11 has integral therewith, and delineated by indentation lines or scorings 17 the carton end closure panels 18 which in the particular instance are square because the four side wall panels 11, 12, 13 and 14 are shown as being of equal width. If two of the side wall panels were to be of different widths than the other two, in alternation among the four, the resulting carton would be of rectangular cross section and not square and the end panels 18 would accordingly be rectangular and not square. If there were only three side wall panels instead of four the end panels would of course be triangular.

The side wall panels 12, 13 and 14 have at their ends sealing flaps or tabs 22 delineated by indentation or scoring lines 23. Along its free edge the side wall panel 11 is provided with a sealing tab 24 delineated by the indentation or scoring line 26. Finally in the case of a carton particularly adapted to hold potable liquids and provided internally with a sipper as taught by Kalajian U.S. Pat. No. 3,259,297, granted July 5, 1966, one of the side wall panels, for example the side wall panel 11 may be provided with a closure flap 27 adjacent to one end of the panel and extending parallel to the long dimension of the side wall panel 11. The flap is produced by cutting through or so nearly through the side wall panel 11 as to enable the flap to be lifted readily up out of the plane of the wall panel 11 to reveal an access orifice, and is produced by making two longitudinal cuts with one transverse cut so that the flap remains integrally attached to the wall panel 11.

The ends of the sealing flaps 22 are cut away at an angle of about 45°. The result is that the confronting ends of adjacent sealing tabs 22 of the side wall panels 12, 13 and 14 form a V notch and the angle between the two confronting ends outlining the V notch is approximately 90° but the confronting ends are so located that if they intersected in a right angle that intersection would not coincide with the end of a scoring line 16 but would be outside or beyond the end of that line. It follows that such point of intersection would also be outside the scoring lines 23 delineating the sealing tabs 22. The result of this is that adjacent sealing tabs 22 have a continuity outside the scoring lines 23. The provision of this continuity is enhanced at the base of the V notch by having the sides of the notch terminate short of a right angle and join instead in a curve which may be an arc of a circle. The straight sides of the notch may have a relation of tangency to the arc. In other words the V notch at its base is not a right angle but is rounded.

The three free edges of each of the end closure panels 18 are embossed marginally along the lines 30 so that the marginal portions outside those lines occupy a plane parallel to and slightly displaced outwardly from the plane of the remainder of the end closure panel. The result is that when the end closure panels 18 are flexed downwardly toward the carton and are brought into surface contact with the sealing tabs 22, the central portion of the closure panel 18 that is bounded by the marginal displaced portions will be depressed toward the interior of the carton relative to those marginally embossed portions. The embossed margins have been identified by the reference numeral 32. It is contemplated that the width of the marginally embossed portions 32 of the closure panel 18 shall be less than the width of the sealing tabs 22 and in one embodiment of the invention the embossed margin has a width of about half the width of the sealing tabs 22. It should be understood at this point that the plan view of the blank 10 in FIG. 1 shows the outside surface of the blank as it will be when formed into a carton and the upper surface of the closure panel 18 as viewed in FIG. 2, which is a section taken on the line 2—2 of FIG. 1, is the outer surface of the end closure panel.

The carton shown in FIG. 3 is formed from the blank 10 into a carton by a series of steps. The first step is to bend or flex the several wall panels at their indentation lines 16 and to bring them around into the form of an open-ended tube with the sealing tab on the side wall panel 11 inside and overlapping the edge of the most remote side wall panel 14. It is contemplated that the blank shall be formed of a paper stock coated with polyethylene to render it impervious to liquids, and the formation of the blank into an open-ended tube is accomplished by heating the outer surface of the sealing tab 24 and the inner surface of the side wall panel 14 that will overlap the sealing tab 24 marginally along that edge, pressing the two surfaces into surface contact and holding them until the polyethylene congeals and a seal has been effected. One form of an apparatus for performing a side-seaming operation on a carton blank of the type disclosed herein is shown in U.S. Pat. No. 3,800,677 granted Apr. 2, 1974 to Charles W. Jones et al.

Another operation that is disclosed in the above-identified Jones et al patent is the limbering of the scoring lines 23 delineating the sealing tabs 22 by bending the tabs along the indentation lines 23 toward the face of the blank that will be the interior of the carton. Polyethylene coated paperboard tends to have a memory so that when relieved of the flexing pressure the sealing tabs tend to self-restore a part of the distance toward their original position of lying in the plane of the blank. The showing of the positions of the sealing tabs 22 at the upper ends of the side wall panels 12 and 13 in the carton shown in FIG. 3 is a reasonable representation of the attitude of the sealing tabs after the limbering operation and prior to being pressed down by the end closure panel 18.

Copending application Ser. No. 628,443, filed by E. Alan Williams on the same day as the present application and assigned to the same assignee, discloses apparatus for closing and sealing a filled carton of the type shown in FIG. 3 of the drawings accompanying the present specification. Although the apparatus shown in the Williams application receives a carton which has had the lower end closed and which has been filled, it will be understood that because the two end closure panels of the blank may be identical and are so shown, the same type of member for engaging the closure panel and pressing it down upon the sealing tabs would be employable for closing both ends of the carton. Accordingly FIG. 3 shows a carton with a lower closure panel closed, and FIGS. 3, 4 and 5 relate to closure of the top of the carton.

As disclosed in the Williams et al. application the equipment for closing and sealing a filled carton includes carton clasping members, designated herein by the reference numerals 40 and 42 for clasping the carton in substantially complete contacting encompassment over a portion of its height immediately below the top of the carton. Relating FIG. 4 to FIG. 3 the members 40 and 42 would be engaging the outsides of the wall panels 11 and 13 respectively and it will be understood that the side wall panels 12 and 14 would be similarly engaged by clasping members. The purpose in clasping the filled carton, as set forth in the Williams et al. application is to preclude crumpling of the side wall panels of the filled carton as pressure is applied to the top.

The reference numeral 44 designates a plate for depressing the carton closure panel 18 into contact with the sealing tabs 22 after the polyethylene has been fused to establish a mutually adhesive condition of the carton closure panel 18 and the sealing tabs 22. The plate 44 is indicated as being pivotally mounted on a pivot pin 46. To match the indented area of the closure panel 18 which is surrounded by the marginally embossed portions 32 the closure panel depressing plate 44 has a central portion of its lower surface protruding relative to its marginal surface portion. This may be accomplished by having the lower surface of the plate 44 recessed in an area corresponding to the depressed portion of the carton closure panel 18 and by providing an insert 48 which seats in the recess in the plate 44, the insert 48 being secured to the plate 44 in any desired manner, such as being provided with a stud 50 which passes through a hole in the plate 44 and is retained by a nut 52 threading on the stud 50.

As shown in FIG. 4 and in greater detail in FIG. 5 the marginal portion of the surface of the plate 44 presses down upon the marginally embossed portion 32 of the carton closure panel 18 and the protruding portion of the insert 48 presses down upon the depressed area of the carton closure panel 18 inside the embossed marginal portions 32. The result of this is, as shown particularly in FIG. 5, that the curving and sloping portions 34 of the closure panel 18, which comprises the transition from the embossed portion 32 to the central portion of the closure panel 18, bears down upon the sealing tabs 22, bending the sealing tabs 22 obliquely downwardly and establishing a surface-to-surface interengagement between the closure panel 18 and the sealing tabs 22 in the curved and sloping transition from one to the other of the two parallel planes defined by the closure panel 18. Also the portion of the plate 44 surrounding the insert 48 presses down upon the tops of the side wall panels 12, 13 and 14 of the carton and applies a flattening pressure to the sealing tabs 22 just inside those walls. The result is that there is a surface-to-surface sealing contact between the outermost portion of the sealing flap 22 and the embossed margin 32 of the closure panel 18 and also between the inwardly sloping portion of the sealing flap 22 and the curving and sloping portions of that embossment and these have been found to provide greater integrity in the seal for the retention of liquids in the carton than may be achieved with a closure panel having an entirely flat or planar surface brought into flat surface contact with the sealing tabs.

The seal obtained in forming a carton from a blank of the type hereinbefore described has been found to be superior to the seal obtainable with a blank of the type disclosed in the Jones patent having sealing tabs on the carton closure panels. It will be understood that a closure plate like the plate 44 may be employed for closing the bottom of the carton. The carton being empty at the time the bottom closure panel is sealed to the sealing tabs a mandrel may be employed internally as a means of reinforcing the side wall panels of the carton against crumpling. However with a filled carton it is not possible to employ a mandrel and the external carton clasping members shown in FIG. 1 provide adequate reinforcement for the side wall panels to obtain a satisfactory liquid-tight seal.

FIG. 6 shows in perspective a corner of a carton in the process of being formed from a blank 10, at the point where the sealing tabs 22 of two of the side panels, which may be the side panels 13 and 14, have been brought down generally into the positions that they will occupy in the completed carton. The bringing of these two flaps down into this position is accomplished by the bringing of the end closure panel 18 into end closing position as shown in FIGS. 4 and 5 but the end panel 18 has been omitted from FIG. 6 in order to show the corner. The bending of the flaps 22 into this position results in the closing of the V notch between the ends of the two adjacent sealing tabs 22 as they pass through a position normal to the side wall panels 13 and 14 of the carton, and a slight reopening of the angle as they continue downwardly into positions corresponding to those shown in FIGS. 4 and 5. Because of the arcuate intersection of the edges of the V notch short of the scoring lines 23 along which the sealing flaps are bent, a slight bulge or protuberance 54 is raised at the corner. When the end closure panel 18 is brought down into surface engagement with the sealing flaps 22 and pressure is applied to the marginally embossed portions of the panel 18 the protuberances 54 are flattened down and pressed inwardly of the carton to form a thickening of the sealing tabs 22 at the corner and thus an additional seal.

Figure 7:
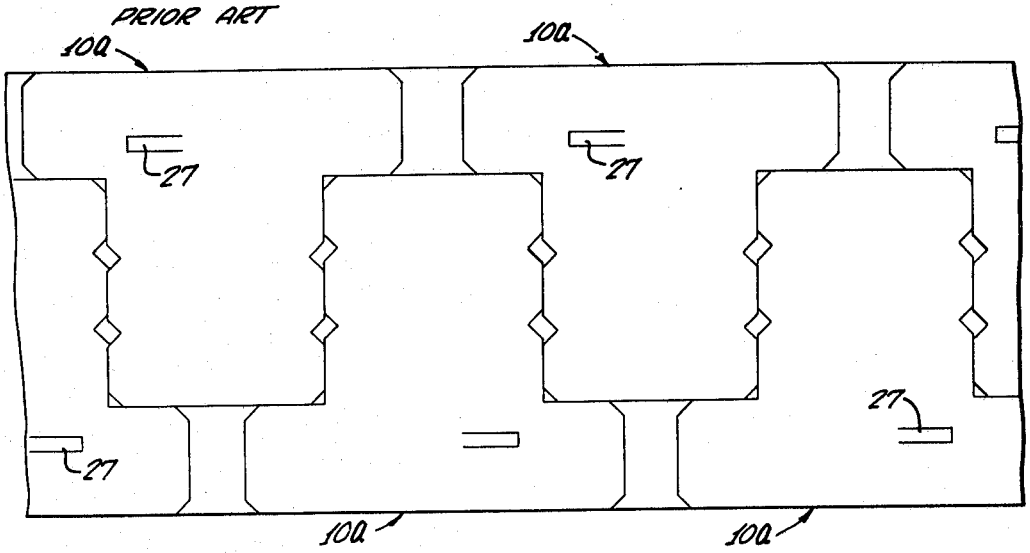
FIG. 7. PRIOR ART
FIG. 7 is a reproduction of FIG. 2 of the Jones patent which shows a pattern for derivation of blanks from a strip of stock by a punching operation.
Figure 8:
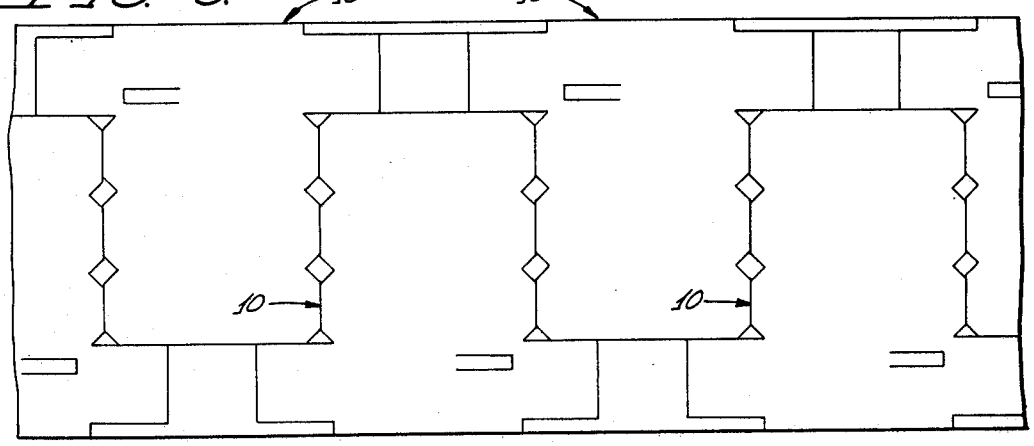
FIG. 8 is a view like FIG. 7 showing a derivation pattern for blanks like those of FIG. 1 of the drawings accompanying the present specification.

FIGS. 7 and 8 show schematically, FIG. 7 for the blank disclosed in the Jones application and FIG. 8 for the modified blank shown herein, how carton blanks 10 may be punched from a web of stock with a minimum of waste. Because of the fact that the blank is T shaped, with the end closure panels integral with an outside one of the side wall panels and thus forming the top of the T, the blanks may be derived from a web of sheet stock in a sequence or arrangement of interspersed inversions, in which the blanks are alternately upright and inverted along the web of sheet stock. It will be seen that the scrap material consists only of the stock material between the end closure panels of two successive blanks standing in the same direction, either upright or inverted, and the chad resulting from the punching out of the V notches. Comparing FIGS. 7 and 8 it will be noted that a narrower strip of stock material may be used to obtain the blanks in FIG. 8 than in FIG. 7, and the amount of reduction is the depth from outer edge to scoring line, the scoring lines not being shown in FIGS. 7 or 8, of the sealing tabs of the end closure panels that face toward the vertical part of the T which the blank forms. Taking as an example one embodiment of a carton which is two inches square and four inches high and has a liquid capacity of approximately one-half pint the reduction in width of the web or strip of stock that would result from elimination of the sealing tabs on the end closure panels of the cartons might reasonably be of the order of two and one-half percent of the total width of the web or strip of paperboard. This may appear to be a relatively small percentage of material saving, but when it is considered that the cartons are nonreusable and accordingly are likely to be supplied on a continuing basis in vast quantities even a saving of this small percentage can be significant from the standpoint of the cost of the carton and the conservation of raw materials. In FIG. 7, which is reproduced from the Jones patent, the carton blanks have been designated by the reference numeral **10*a* since they are not identical with the blanks identified by the reference numeral 10** in the present specification.

It will be understood that although the foregoing disclosure of the forming and closing of the carton is based upon the utilization of a T-shaped blank it is not limited to utilization of a blank having that configuration. It will be apparent that any one of the side wall panels 11, 12, 13 and 14 could have an end closure panel at one end and a sealing tab at its opposite end. The only restriction is that the closure panels must be so located as to provide for closure of two ends of the carton. Any combination within this restriction would, for a rectangular carton, provide for the sealing of each end closure panel to three sealing tabs. The T-shaped blank has the advantage that it may be derived from a continuous strip of sheet material in an economical way from the standpoint of scrap loss.

What is claimed is:

1. The method of forming a carton from components comprising an open-ended tube of polygonal cross section having inwardly foldable sealing tabs integral with at least some of the walls of the tube at at least one end of the tube and an end closure panel integral with a side wall at at least an end of the tube having said sealing tabs, said end closure panel having a polygonal configuration matching that of the tube and being marginally embossed along its free edges, which comprises the steps of:

establishing a condition for permanent interengagement between the outer surfaces of the sealing tabs and the inner surface of the end closure panel;

folding the sealing flaps inwardly and bringing the integral end closure panel into generally flush closure relation to the end of the tube with the inner surface of the end closure panel in surface engagement with the sealing tabs; and applying pressure directly on the marginally embossed portion of the end closure panel and concurrently applying pressure directly on the portion of the end closure panel confined by said marginally embossed portion to effect attachment of said end closure panel to said sealing tabs accompanied by depression of the sealing tabs by the embossed end closure panel into a downwardly sloping attitude inside the carton.

2. The method of closing a carton comprised of a tube of polygonal cross section closed at one end and having at the open end a marginally embossed end closure panel integral with one of the side walls and having a polygonal configuration matching that of the tube, and having at said open end sealing tabs integral with the other side walls, which comprises the steps of:

establishing a condition for permanent interengagement between the outer surfaces of the sealing tabs and the inner surface of the end closure panel;

folding the sealing flaps inwardly and bringing the integral end closure panel into generally flush closure relation to the end of the tube with the inner surface of the end closure panel in surface engagement with the sealing tabs; and applying pressure directly on the marginally embossed portions of the end closure panel and concurrently applying pressure directly on the portion of the end closure panel confined by said marginally embossed portion to effect attachment of said end closure panel to said sealing tabs accompanied by depression of the sealing tabs by the embossed end closure panel into a downwardly sloping attitude inside the carton.

3. The method of closing a carton comprised of a tube of polygonal cross section closed at one end and having at the open end a closure panel integral with one of the side walls and having a polygonal configuration corresponding to the polygonal cross section of the tube, and having at said open end sealing tabs integral with the other side walls, which comprises the steps of:

folding the sealing tabs inwardly so as to extend obliquely down and into the carton;

folding the closure panel downwardly upon the open end of the carton;

pressing the closure panel into contact with the sealing tabs in a manner such that the portion of the closure panel then presented interiorly of the side walls is depressed to a lower level than the margins of the closure, and a portion of the closure is in contact with the oblique sealing tabs; and effecting adhesive attachment of the closure panel to the side wall ends and to the sealing tabs along the lines of contact of the closure panel therewith.

4. The method defined in claim 5 wherein:

the closure panel and the side wall ends and integral sealing tabs are coated with a fusible and congealable substance at least at the points of closure contact and the adhesive attachment is accomplished by the successive steps of fusing and congealing the substance.

5. The method defined in claim 3 wherein:

the closure panel and the side wall ends and integral sealing tabs are coated with polyethylene at least at the points of closure contact and the adhesive attachment is accomplished by the successive fusing and congealing of the polyethylene.

* * * * *